US007587904B2

(12) United States Patent
Sanders

(10) Patent No.: US 7,587,904 B2
(45) Date of Patent: Sep. 15, 2009

(54) REFRIGERATION SYSTEM WITH SPRING ROD

(75) Inventor: Joseph F. Sanders, North Richland Hills, TX (US)

(73) Assignee: Premark FEG L.L.C., Wilmington, DE (US)

( * ) Notice: Subject to any disclaimer, the term of this patent is extended or adjusted under 35 U.S.C. 154(b) by 566 days.

(21) Appl. No.: 11/171,151

(22) Filed: Jun. 30, 2005

(65) Prior Publication Data

US 2007/0000272 A1 Jan. 4, 2007

(51) Int. Cl.
*F25D 19/00* (2006.01)

(52) U.S. Cl. ..... 62/77; 29/452; 62/295; 62/298

(58) Field of Classification Search ..... 62/267, 62/272, 285, 77, 295, 297, 298; 29/452–453
See application file for complete search history.

(56) References Cited

U.S. PATENT DOCUMENTS 2,065,391 A * 12/1936 Nance ..... 312/308
2,145,775 A 1/1939 Muffly
2,454,727 A 11/1948 Wherry
2,587,246 A 2/1952 Touborg
2,627,170 A 2/1953 Touborg
2,628,016 A 2/1953 Higham
2,977,043 A 3/1961 Scheldorf
3,006,159 A 10/1961 Brown et al.
3,183,681 A * 5/1965 Lutz et al. ..... 62/135
3,357,763 A * 12/1967 Toper ..... 312/236
3,783,635 A 1/1974 Perez
3,926,007 A 12/1975 Braden et al.
4,492,017 A * 1/1985 Latter ..... 29/434
4,716,275 A 12/1987 Waldschmidt
4,766,736 A 8/1988 Waldschmidt
4,888,962 A * 12/1989 Harper et al. ..... 62/503
4,977,750 A * 12/1990 Metcalfe ..... 62/77
5,070,708 A 12/1991 Malosh et al.
5,140,830 A * 8/1992 Sawyer ..... 62/298
5,848,536 A * 12/1998 Dodge et al. ..... 62/240
7,328,590 B2 * 2/2008 Sherlock ..... 62/305

* cited by examiner

*Primary Examiner*—William E Tapolcai
(74) *Attorney, Agent, or Firm*—Thompson Hine LLP

(57) ABSTRACT

A refrigeration unit includes a housing including an insulated compartment having opposing first and second walls. A spring rod has a first end mounted at a first location to the first wall of the insulated compartment and a second end mounted at a second location to the second wall of the insulated compartment. An evaporator assembly includes a component mounted to the insulated compartment by the spring rod. A shoulder of the spring rod exerts a force against the component in a direction toward the first wall to limit movement of the component mounted to the insulated compartment.

29 Claims, 7 Drawing Sheets

REFRIGERATION SYSTEM WITH SPRING ROD

TECHNICAL FIELD

The present application relates generally to refrigeration systems, and more particularly to a refrigeration assembly including a spring rod.

BACKGROUND

Refrigerators are used in numerous settings, such as in a commercial setting or in a domestic setting. Typically, refrigerators are used to store and maintain food products by providing a cooled environment into which the products can be stored. Refrigeration systems typically include a refrigeration cabinet into which the food products are placed and a refrigeration assembly for cooling the air and products in the refrigeration cabinet.

The refrigeration assembly often includes an evaporator assembly and a condenser assembly, each forming a portion of a refrigerant loop or circuit. The refrigerant is used to carry heat from air within the refrigeration cabinet. The refrigerant picks up heat in the evaporator assembly and then gives off heat in the condenser assembly.

At least some of the components of the evaporator assembly can be mounted within an insulated compartment. As such, suitable mounting structure for mounting the components within the insulated compartment is desired.

SUMMARY

In an aspect, a refrigeration unit includes a housing including an insulated compartment having opposing first and second walls. A spring rod has a first end mounted at a first location to the first wall of the insulated compartment and a second end mounted at a second location to the second wall of the insulated compartment. An evaporator assembly includes a component mounted to the insulated compartment by the spring rod. A shoulder of the spring rod exerts a force against the component in a direction toward the first wall to limit the movement of the component mounted to the insulated compartment.

In another aspect, a refrigeration unit has an evaporator assembly and a condenser assembly connected to the evaporator assembly. The refrigeration unit further includes a spring rod supporting the evaporator coil within an insulated compartment. The spring rod has a first end mounted at a first location to the first wall of the insulated compartment and a second end mounted at a second location to the second wall of the insulated compartment. An evaporator coil mounting structure is used to mount the evaporator coil in the insulated compartment. The spring rod has a shoulder that exerts a force against the evaporator coil mounting structure in a direction toward the first wall to limit the movement of the evaporator coil in the insulated compartment.

In another aspect, a method of assembling a refrigeration unit is provided. The method includes providing a spring rod having a shoulder located between a first end of the spring rod and an opposite, second end of the spring rod. A component of an evaporator assembly is engaged with the spring rod. The spring rod is loaded such that the shoulder of the spring rod is biased against the component. The first end is engaged with a first mount located at a first wall of an insulated compartment. The second end is engaged with a second mount located at a second wall of the insulated compartment. The shoulder is biased against the component with the first and second ends engaged with the respective first and second mounts.

In another aspect, a refrigeration unit includes a housing including an insulated compartment having opposing first and second walls. An evaporator coil is at least partially disposed in the insulated compartment. A spring rod supports at least one of the evaporator coil, a drip pan and a fan shroud in the insulated compartment. The spring rod has a first end mounted at a first location in the insulated compartment and a second end mounted at a second location of the second wall of the insulated compartment such that a linear distance from the first location to the second location is less than an unloaded length of the spring rod.

DETAILED DESCRIPTION

Figure 1:
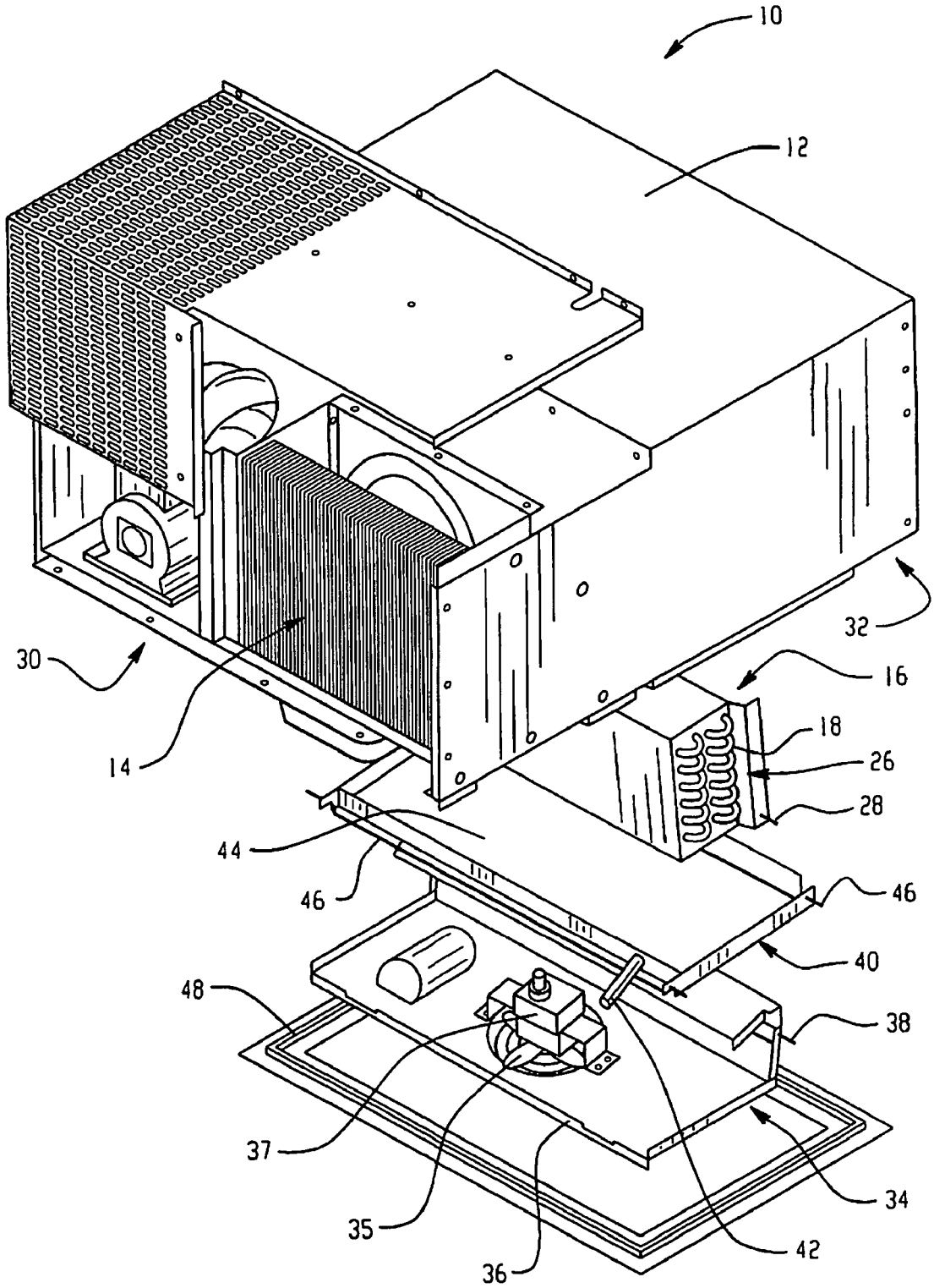
FIG. 1 is an exploded, perspective view of an embodiment of a refrigeration module.

Referring to FIG. 1, a refrigeration module 10 for use with a refrigeration appliance such as a vending machine, refrigerator, freezer, etc. includes a housing 12 having a compartment 30 housing a condenser assembly 14 and another, insulated compartment 32 housing an evaporator assembly 16. Evaporator assembly 16 includes an evaporator coil assembly 26, mounting structure 28 for use in mounting the evaporator coil assembly 26 within the insulated compartment 32 and a fan assembly 34 for circulating air over an evaporator coil 18. Fan assembly 34 includes a fan 35, a fan motor 37 operatively connected to the fan 35 and a fan shroud 36 having mounting structure 38 that is used to mount the fan assembly in the insulated compartment 32. A drain pan assembly 40 is located to receive moisture falling from the evaporator coil assembly 26. Drain pan assembly 40 includes mounting structures 46 that are used to mount the drain pan assembly within the second compartment 32 and beneath the evaporator coil assembly 26 and a drain conduit 42 for directing accumulated moisture (i.e., condensate) from drain pan 44. A gasket 48 seals the evaporator assembly 16 within housing 12.

Figure 2:
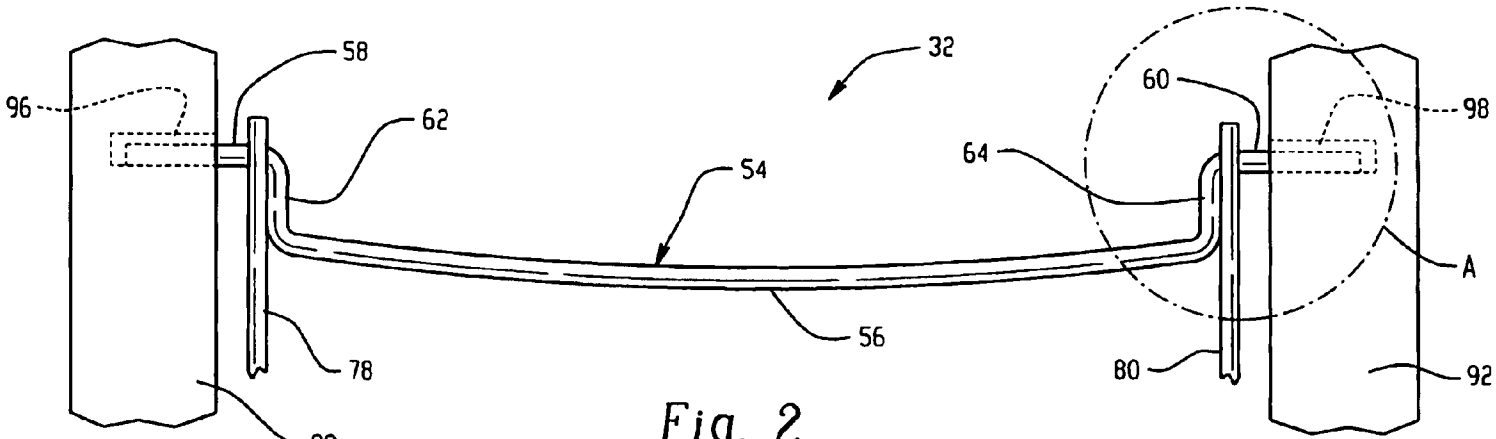
FIG. 2 is a front view of an embodiment of a spring rod mounting an evaporator assembly component in an insulated compartment of the refrigeration module of FIG. 1.

Referring to FIG. 2, an example of suitable mounting structure for use in mounting one or more components of the evaporator assembly 16 at locations in the insulated compartment 32 (e.g., illustrated as mounting structures 28, 38 and 46 in FIG. 1) is shown. The mounting structure is in the form of a spring rod 54 (illustrated in a loaded state) that cooperates with component mounting structure fixed to the component, here shown in part as bracket arms 78 and 80, to mount the component within the insulated compartment 32. Loaded spring rod 54 includes a bent central portion 56 that is connected to opposite end portions 58 and 60 by shoulders 62 and 64.

End portions 58, 60 of the spring rod 54 extend through openings in the bracket arms 78, 80 to secure the spring rod 54 therebetween with shoulders 62 and 64 biased outwardly by the bend into contact with the arms. To mount the component within the insulated compartment 32, in the illustrated example, ends 70 and 72 are positioned within rod-receiving mounts (e.g., openings 96 and 98) located at opposing walls 90, 92 of the insulated compartment. In an alternative arrangement, the rod-receiving mounts could be formed using brackets (not shown) that are attached to the walls 90, 92. As shown, the arms 78 and 80 are spaced apart from the walls 90 and 92, however, in other embodiments, the arms (or one arm) could contact the walls.

Figure 2A:
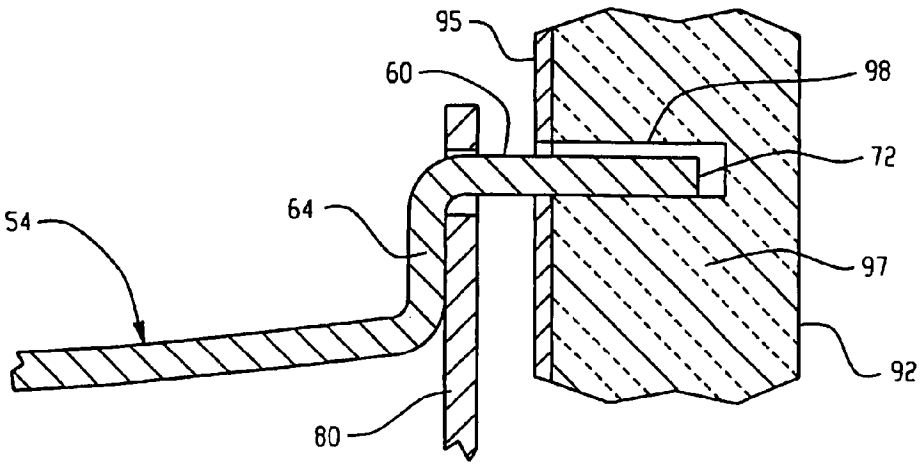
FIG. 2A is a detail, section view at area A of FIG. 2.

FIG. 2A shows an enlarged view of rod end portion 60 passing through bracket arm 80 and into opening 98 in wall 92. Wall 92 is shown with a metal skin 95 covering foam insulation 97.

Figure 3:
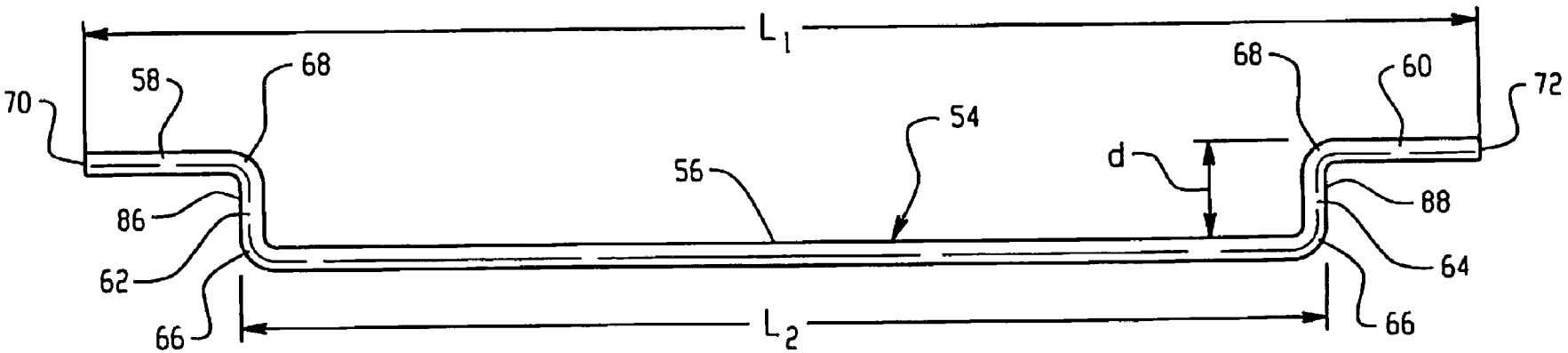
FIG. 3 is a front view of the spring rod of FIG. 2 in an unloaded state.

Referring now to FIG. 3, spring rod 54 is illustrated in an unloaded configuration (e.g., prior to its connection to the evaporator assembly component) with central portion 56 being relatively straight and offset end portions 58 and 60 extending substantially parallel to the central portion. Shoulders 62 and 64 connect the central portion 56 to respective end portions 58 and 60 at bends 66 and 68. Shoulders 62 and 64 extend away from the central portion 56 to span an offset distance d between the end portions 58 and 60 and the central portion such that the spring rod 54 forms somewhat of a U-shape having an unloaded length $L_1$ measured from end 70 to end 72 and an unloaded length $L_2$ measured from an outer surface 86 of shoulder 62 to an outer surface 88 of shoulder 64. While a U-shaped spring rod is illustrated, other configurations are possible (see FIG. 8 as an example). As shown, each of the central and end portions 56, 58 and 60, respectively, of the spring rod 54 have the same cross-sectional shape (e.g., round, polygonal, flat, etc.), however, the portions may have differing cross sections. For example, the central portion 56 may have a round cross section while the end portions 58 and 60 (or at least a length of the end portions) may include square cross sections (e.g., which may be used to inhibit rotation of the spring rod 54 when mounted within the insulated compartment 32).

Spring rod 54 is formed with an elastic quality such that when bent as shown in FIG. 2 the rod seeks to return to its unloaded orientation shown in FIG. 3. The spring rod 54 can be flexible enough such that it can be bent a desired amount without permanent deformation and assembled with the other components. Spring rod 54 is also rigid enough so that it can support the component within the insulated compartment 32. Suitable materials for forming the spring rod 54 include metals, such as steel including stainless steel. Any suitable method can be used to form the spring rod 54 including drawing, extrusion, bending, casting, etc. or any combination thereof.

Figure 4:
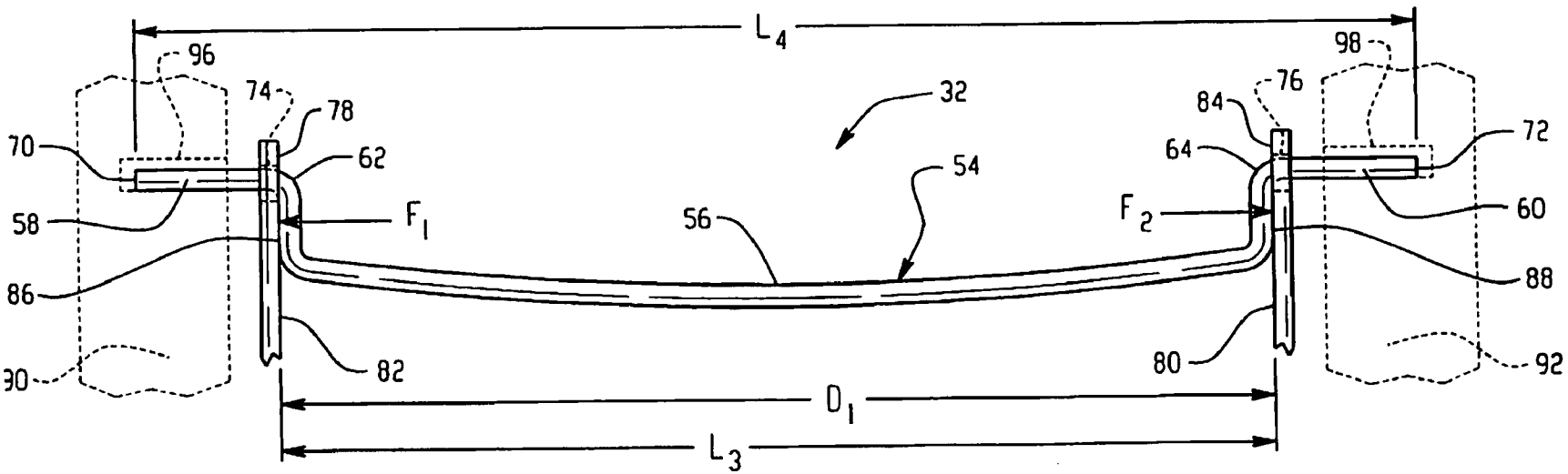
FIG. 4 is a front, schematic view of the spring rod of FIG. 2 mounting a component in an insulated compartment and emphasizing the spring rod in a loaded state.

Referring to FIG. 4, a schematic view of spring rod 54 mounting an evaporator assembly component, such as the evaporator coil assembly 26, the fan assembly 34 or the drain pan assembly 40 in the insulated compartment 32 is shown. Each end 70, 72 of spring rod 54 is mounted through the respective opening 74, 76 that extends through the associated bracket arm 78, 80 of the component as described above. The substantially fixed distance $D_1$ between inner surfaces 82 and 84 of arms 78 and 80 is less than the unloaded length $L_2$ between outer surfaces 86 and 88 of shoulders 62 and 64 (FIG. 3). As a result, mounting spring rod 54 within holes 74 and 76 of arms 78, 80 causes the spring rod 54 to remain bent such that central portion 56 has a length $L_3$ that is less than its unloaded length $L_2$. In its loaded state, spring rod 54 also has an overall length $L_4$ between ends 70 and 72 that is less than its unloaded length $L_1$ (FIG. 3).

As noted above, spring rod 54 exerts a force when deformed. Forces $F_1$ and $F_2$ are applied by the shoulders 62 and 64 to the bracket arms 78 and 80 at a location near openings 74, 76 to bias the shoulders thereagainst. The application of forces $F_1$ and $F_2$ serves to provide some rigidity to the connection between the spring rod 54 and the component thereby reducing the potential for relative movement between the spring rod and the component to which it is mounted. In particular, application of $F_1$ and $F_2$ by the shoulders 62 and 64 to the bracket arms 78 and 80 can serve to limit linear movement of the component along the length of the spring rod 54 and also to limit rotational movement of the component about the spring rod by increasing the friction between the bracket arms and the spring rod.

Figure 5:
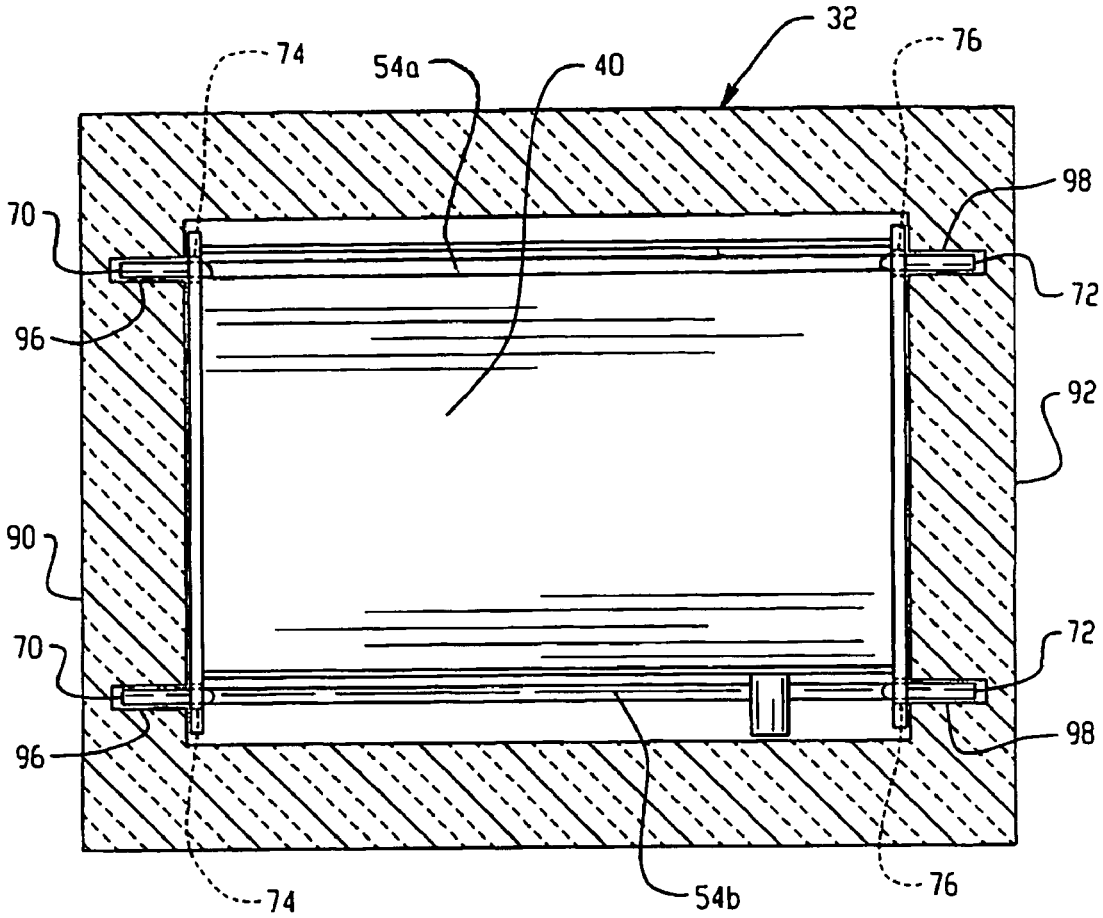
FIG. 5 is top view of an embodiment of a drip pan assembly mounted within an embodiment of an insulated compartment using the spring rod of FIG. 2.
Figure 6:
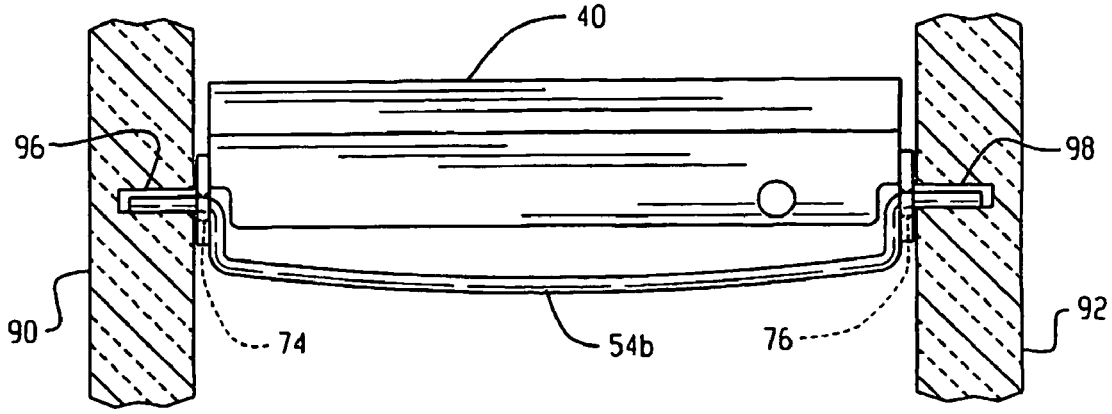
FIG. 6 is a front view of the drip pan assembly of FIG. 5 mounted to the insulated compartment.

In an embodiment, a mounting operation for mounting an evaporator component within the insulated compartment 32 includes inserting the end portions 58 and 60 through respective holes 74 and 76 in the arms 78 and 80 of mounting structure affixed to the evaporator assembly component. In most instances, the spring rod 54 will be bent or deformed (e.g., manually) while inserting at least one of the end portions 58 and 60 through the arms 78 and 80. In some instances, the spring rod 54 will be unloaded to an extent to allow both the end portions 58 to pass through the holes 74 and 76 with the end portions protruding outwardly from the arms to expose ends 70 and 72. With the spring rod 54 mounted between the arms 78 and 80, the spring rod remains bent with the shoulders 62 and 64 being biased against the arms 78 and 80, each applying a force to a respective arm. The end portions 58 and 60 protrude outwardly from sides of the arms 78 and 80 that are opposite the sides against which the shoulders 62 and 64 are biased. The spring rod 54 and component are then mounted to the walls 90 and 92 (illustrated by dotted lines) within the insulated compartment 32 (FIG. 1; see FIGS. 5 and 6 also). In the illustrated example, the spring rod 54 is mounted within the compartment 32 by inserting the ends 70 and 72 within rod-receiving mounts (e.g., openings 96 and 98) located at the opposing walls 90, 92. Bending of the spring rod 54 also takes place during this step. In an alternative technique, the spring rod ends 70, 72 may be inserted through the bracket arms 78 and 80 and the rod-receiving mounts in a near simultaneous manner (i.e., with only a single bending operation of the spring rod 54 required).

Referring to FIGS. 5 and 6, multiple spring rods 54 can be used to mount evaporator assembly 16 components within the insulated compartment 32. In the illustrated embodiment, spring rods 54*a* and 54*b* are used to mount the drain pan assembly 40 in the insulated compartment 32, for example, below the evaporator coil assembly 26 (not shown; see FIG. 1) to allow the drain pan to collect condensate falling from the evaporator coil. Spring rods 54*a* and 54*b* are substantially parallel to each other and each have ends 70, 72 that extend through respective openings 74, 76 and are received within respective openings 96, 98 formed in opposite walls 90, 92 of the insulated compartment as described above.

Figure 7:
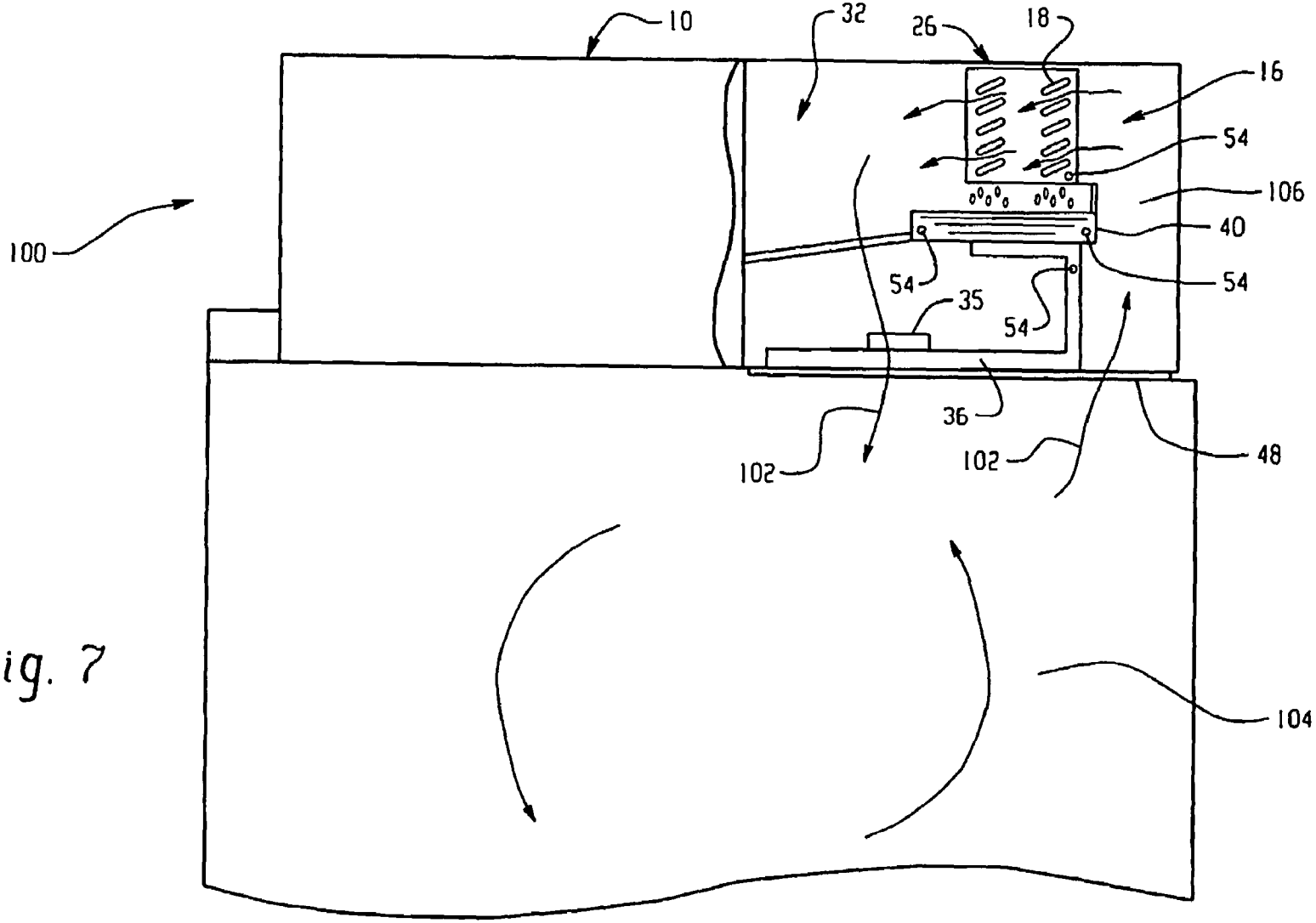
FIG. 7 is a schematic view of a refrigeration appliance including the refrigeration module of FIG. 1.

Referring now to FIG. 7, a refrigeration appliance 100 including the refrigeration module 10 with evaporator assembly 16 is shown. Each of the evaporator coil assembly 26 including coils 18, drip pan assembly 40 and fan assembly 36 including fan 35 is located within insulated compartment 32 using spring rods 54 having ends that are mounted at locations on sidewalls of the compartment, as described above. Fan assembly 36 is mounted as the lowermost component such that the fan 35 can draw air 102 from the cabinet 104, along air flow path 106 and through the evaporator coils 18 for cooling the air. Drip pan assembly 40 is mounted between the fan assembly 36 and the evaporator coil assembly 26 such that the drip pan can receive condensate dripping from the evaporator coil assembly 26. Evaporator coil assembly 26 is mounted as the uppermost component such that air 102 drawn in by the fan 35 is forced through the evaporator coil assembly. The cool air 102 is then forced out of the insulated compartment 32 and into the cabinet 104.

Spring rod(s) 54 provides both locating structure and bracing structure for the component, such as the evaporator coil assembly 26, the fan assembly 34 or the drain pan assembly 40 it mounts within the insulated compartment 32. Such bracing can reduce the potential of relative movement (e.g., linear and rotational) between the spring rod 54 and the component, which can reduce noise and maintenance requirements of the system. Spring rod 54 can also reduce tolerance concerns during assembly. For example, in some embodiments, the walls of the insulated compartment 32 are formed by providing a metal skin into which an expanding foam insulation is injected. In these instances, it can be difficult (and expensive) to repeatedly control dimensions of the walls from compartment to compartment. Use of spring rod 54 allows for deviation in dimensions between compartments 32 because the spring rod is made long enough to account for such variation where the spring rod applies forces $F_1$ and $F_2$ to the component, rigidity of the component mounting can be maintained.

Figure 8:
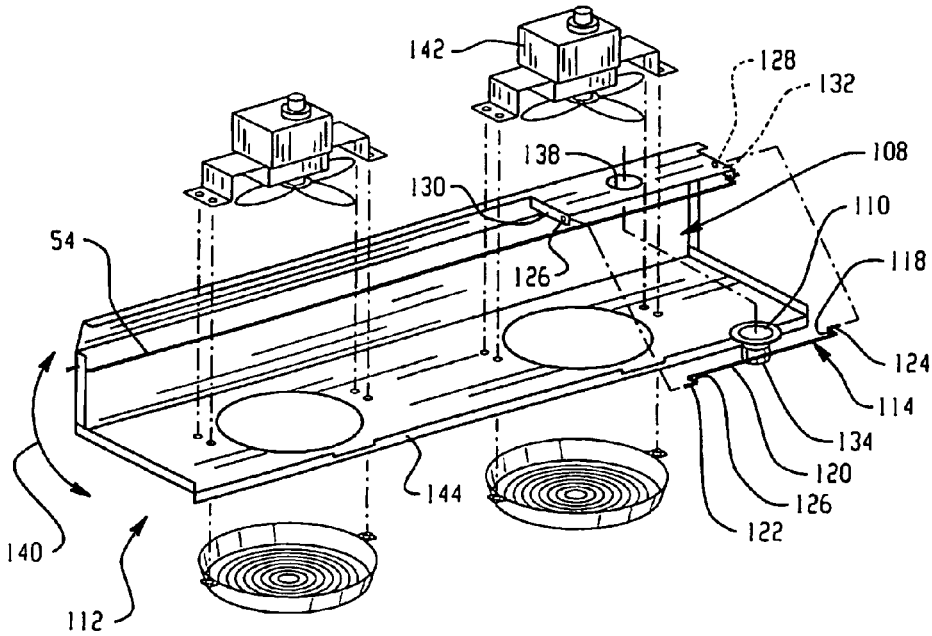
FIG. 8 is an exploded, perspective view of a fan assembly including another embodiment of a spring rod.
Figure 9:
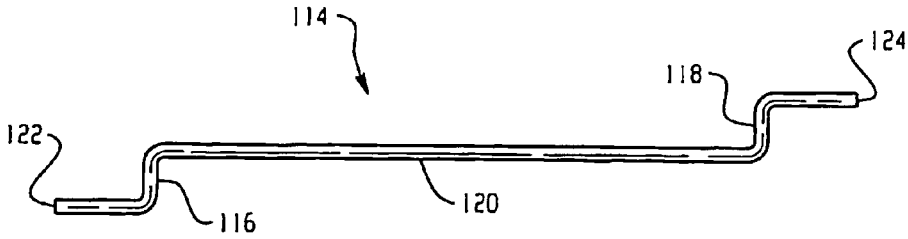
FIG. 9 is a front view of the spring rod of FIG. 8.

Referring to FIGS. 8 and 9, a spring rod can be used to mount certain evaporator assembly 16 components together. In this instance, a thermostat 110 is mounted to a fan shroud 108 of a fan assembly embodiment 112 using another spring rod embodiment 114. Unlike spring rod 54 (see, e.g., FIG. 3), shoulders 116 and 118 of spring rod 114 extend from opposite sides of central portion 120. End portions 122 and 124 are received within respective openings 126 and 128 located through arms 130 and 132 of the fan shroud 108. The thermostat 110 is supported by locating a ledge of the thermostat beneath the central portion 120 of the spring rod 114. The spring rod 114 inhibits end 134 from being removed through hole 138.

It is to be clearly understood that the above description is intended by way of illustration and example only and is not intended to be taken by way of limitation. For example, in some embodiments, the end portions 58 and 60 may not be substantially parallel to the central portion 56. In some instances, the spring rod 54 can provide pivot structure that allows a component to which it is connected to pivot relative to the spring rod. For example, referring to FIG. 8, spring rod 54 may allow the fan shroud 108 to pivot about the spring rod (e.g., in the direction of arrow 140 as mounted within the insulated compartment 32. This can allow for access to various components of the fan assembly 112, such as the fan motor 142. In some embodiments, side 144 opposite the spring rod 54 may be releasably clamped within the insulated compartment to inhibit rotation of the fan shroud 108 until side 144 is released. Other changes and modifications could be made.

What is claimed is:

1. A refrigeration unit comprising:

a housing including an insulated compartment having opposing first and second walls;

a spring rod having a first end mounted at a first location to the first wall of the insulated compartment and a second end mounted at a second location to the second wall of the insulated compartment; and an evaporator assembly including a component mounted to the insulated compartment by the spring rod;

wherein the spring rod has a shoulder formed by a bend in the spring rod offset from the first end, the shoulder exerts a force against the component in a direction toward the first wall to limit movement of the component relative to the spring rod;

wherein the component is an evaporator coil, a drip pan or a fan assembly.

2. The refrigeration unit of claim 1, wherein the shoulder of the spring rod exerts a force on a wall of the component near a hole in the component with the hole lined up with an opening in the first wall and a first end portion including the first end of the spring rod extending through both the hole and the opening.

3. The refrigeration unit of claim 1, wherein the component is an evaporator coil.

4. The refrigeration unit of claim 1, wherein the component is a drip pan.

5. The refrigeration unit of claim 4 further comprising a second spring rod that mounts the drip pan to the insulated compartment wherein the second spring rod has a shoulder that exerts a force against the drip pan in a direction toward the first wall to limit movement of the drip pan mounted to the insulated compartment.

6. The refrigeration unit of claim 5, wherein the spring rods are substantially parallel.

7. The refrigeration unit of claim 1, wherein the component is a fan assembly.

8. The refrigeration unit of claim 7 further comprising a thermostat mounted to the fan assembly by a second spring rod having a first end mounted at a first location on a bracket of the fan assembly and a second end mounted at a second location to the fan assembly wherein the second spring rod has a shoulder that exerts a force against the fan assembly, the second spring rod limiting movement of the thermostat mounted to the fan assembly.

9. The refrigeration unit of claim 1, wherein the first end is mounted within a wall opening located at the first location and the second end is mounted within a wall opening located at the second location.

10. The refrigeration unit of claim 1, wherein the spring rod has an unloaded length measured between the ends of the spring rod that is greater than a loaded length on the spring rod measured between the ends of the spring rod as mounted to the insulated compartment.

11. The refrigeration unit of claim 1, wherein the spring rod has a second shoulder formed by a bend offset from the second end that exerts a force against the component in a direction toward the second wall to brace the component mounted to the insulated compartment.

12. A refrigeration unit including an evaporator assembly and a condenser assembly connected to the evaporator assembly, the refrigeration unit comprising:

a spring rod supporting the evaporator coil within an insulated compartment, the spring rod having a first end mounted at a first location to the first wall of the insulated compartment and a second end mounted at a second location to the second wall of the insulated compartment;

an evaporator coil mounting structure used to mount the evaporator coil in the insulated compartment;

wherein the spring rod has a shoulder formed by a bend offset from the first end, the shoulder exerts a force against the evaporator coil mounting structure in a direction toward the first wall to limit movement of the evaporator coil in the insulated compartment.

13. The refrigeration unit of claim 12, wherein the spring rod is a first spring rod, the refrigeration unit further comprising a drip pan assembly and a second spring rod supporting the drip pan assembly, the second spring rod having a first end mounted at a third location to the first wall of the insulated compartment and a second end mounted at a fourth location to the second wall of the insulated compartment wherein the second spring rod has a shoulder that exerts a force against the drip pan assembly in a direction toward the first wall to limit movement of the drip pan assembly mounted to the insulated compartment.

14. The refrigeration unit of claim 13 further comprising a fan assembly and a third spring rod supporting the fan assembly, the third spring rod having a first end mounted at a fifth location to the first wall of the insulated compartment and a second end mounted at a sixth location to the second wall of the insulated compartment wherein the third spring rod has a shoulder that exerts a force against the fan assembly in a direction toward the first wall to limit movement of the fan assembly mounted to the insulated compartment.

15. The refrigeration unit of claim 14 further comprising a thermostat, the thermostat being mounted to the fan assembly by a fourth spring rod.

16. The refrigeration unit of claim 15, wherein the fourth spring rod has a first end mounted to the fan assembly at a first location and a second end mounted to the fan assembly at a second location, the fourth spring rod limiting movement of the thermostat mounted to the fan assembly.

17. The refrigeration unit of claim 13 further comprising a third spring rod supporting the drip pan assembly, the third spring rod having a first end mounted at a fifth location to the first wall of the insulated compartment and a second end mounted at a sixth location to the second wall of the insulated compartment wherein the third spring rod has a shoulder that exerts a force against the drip pan assembly in a direction toward the first wall to limit movement of the drip pan assembly mounted to the insulated compartment.

18. The refrigeration unit of claim 17, wherein the second and third spring rods are substantially parallel.

19. The refrigeration unit of claim 12, wherein the first end is mounted within a wall opening located at the first location and the second end is mounted within a wall opening located at the second location.

20. The refrigeration unit of claim 12, wherein the spring rod has an unloaded length measured between the ends of the spring rod that is greater than a loaded length of the spring rod measured between the ends of the spring rod as mounted to the insulated compartment.

21. The refrigeration unit of claim 12, wherein the shoulder of the spring rod exerts a force on a wall of the component near a hole in the evaporator coil mounting structure with the hole lined up with an opening in the first wall and a first end portion including the first end of the spring rod extending through both the hole and the opening.

22. The refrigeration unit of claim 12, wherein the spring rod has a second shoulder that exerts a force against the evaporator coil mounting structure in a direction toward the second wall to limit movement of the component mounted to the insulated compartment.

23. A method of assembling a refrigeration unit, the method comprising:

providing a spring rod having a shoulder located between a first end of the spring rod and an opposite, second end of the spring rod, the shoulder being offset from both the first and second ends of the spring rod;

engaging a component of an evaporator assembly with the spring rod;

loading the spring rod such that the shoulder of the spring rod is biased against the component;

engaging the first end with a first mount located at a first wall of an insulated compartment; and engaging the second end with a second mount located at a second wall of the insulated compartment, the second wall opposing the first wall;

the shoulder being biased against the component with the first and second ends engaged with the respective first and second mounts;

wherein the component is an evaporator coil assembly, a drip pan assembly or a fan assembly.

24. The method of claim 23, wherein the component is an evaporator coil assembly.

25. The method of claim 23, wherein the component is a drip pan assembly.

26. The method of claim 23, wherein the component is a fan assembly.

27. A refrigeration unit comprising:

a housing including an insulated compartment having opposing first and second walls;

an evaporator coil at least partially disposed in the insulated compartment; and a spring rod supporting at least one of the evaporator coil, a drip pan and a fan shroud in the insulated compartment, the spring rod having a first end mounted at a first location in the insulated compartment and a second end mounted at a second location of the second wall of the insulated compartment;

wherein a linear distance from the first location to the second location is less than an unloaded length of the spring rod.

28. The refrigeration unit of claim 27, wherein the spring rod is mounted at the first location within a first opening in the first wall and at the second location within a second opening within the second wall.

29. The refrigeration unit of claim 27, wherein the spring rod has a compressed length between the first and second walls.

* * * * *